United States Patent [19]

Schaller

[11] Patent Number: 4,544,221

[45] Date of Patent: Oct. 1, 1985

[54] CABLE LEAD-IN FOR ENCAPSULATED ELECTRICAL EQUIPMENT

[75] Inventor: Werner Schaller, Lampertheim, Fed. Rep. of Germany

[73] Assignee: Siemens Aktiengesellschaft, Munich, Fed. Rep. of Germany

[21] Appl. No.: 462,896

[22] Filed: Feb. 1, 1983

[30] Foreign Application Priority Data

Feb. 9, 1982 [DE] Fed. Rep. of Germany ..... 3204414

[51] Int. Cl.[4] ..... H01R 11/00

[52] U.S. Cl. ..... 339/60 M; 339/61 M

[58] Field of Search ..... 339/60 R, 60 M, 61 R, 339/61 M, 94 M

[56] References Cited

U.S. PATENT DOCUMENTS

| | | | |
|---|---|---|---|
| 2,749,526 | 6/1956 | Petersen | 339/61 M |
| 2,892,990 | 6/1959 | Werndl | 339/60 M |
| 3,040,285 | 6/1962 | Stanley | 339/60 R |
| 3,271,727 | 9/1966 | Nelson | 339/94 M |
| 3,397,378 | 8/1968 | Dietrich | 339/60 M |
| 3,626,356 | 12/1971 | Trammell | 339/94 M |
| 3,665,509 | 5/1972 | Elkins | 339/60 M |
| 3,982,059 | 9/1976 | Holland et al. | 339/61 M |
| 4,299,431 | 11/1981 | Wilson et al. | 339/60 R |

FOREIGN PATENT DOCUMENTS 701907 1/1941 Fed. Rep. of Germany .

*Primary Examiner*—Gil Weidenfeld
*Assistant Examiner*—Gary F. Paumen
*Attorney, Agent, or Firm*—Kenyon & Kenyon

[57] ABSTRACT

A cable lead-in arrangement for encapsulated electrical equipment having a compressible sealing member adapted to enter an opening in the housing. The compressible sealing member is provided with window-like openings through which protrude conductor elements of the cable for engaging ring-shaped contact elements arranged in the inner surface of the opening in the housing. The arrangement is further provided with a compression element which is adapted to apply an axially compressive force to the sealing member so as to apply an advantageously high contact pressure between the contact elements of the opening in the housing and the conductor elements of the cable. Such contact pressure also ensures against the introduction of environmental influences into the equipment. An embodiment is presented for holding the cable at an angle with respect to an axis of the sealing member.

7 Claims, 2 Drawing Figures

CABLE LEAD-IN FOR ENCAPSULATED ELECTRICAL EQUIPMENT

BACKGROUND OF THE INVENTION

This invention relates generally to cable lead-in arrangements for encapsulated electrical equipment, and more particularly, to a cable lead-in which utilizes an elastically compressible sealing member which surrounds the cable and is braced between the cable and the housing of the equipment.

A cable lead-in arrangement which utilizes an elastically compressible sealing member is described in German Pat. No. 701,907. In this known arrangement, the outer jacket of the cable is surrounded by the sealing member which is compressed by a screw-type compression gland for sealing the cable when it is brought into the housing. In this arrangement, the connections are made via a separate screw or other terminals which are provided in the interior of the housing.

SUMMARY OF THE INVENTION

In accordance with the invention, a cable lead-in of the known type is improved in a manner whereby the electrical connection between the cable and the equipment is made simultaneously with the sealing process for the cable to be brought in. This is achieved in a simple manner by inserting connecting elements between the housing and the sealing member. The connecting elements are brought into electrically conductive contact by compressing the sealing member with contactable lead elements which pass through the sealing member and are in contact with the cable. The connecting elements are part of a flexible circuit, thereby facilitating their insertion.

In arrangements where the connecting elements are part of a flexible circuit, the connecting elements can be held relative to the sealing member without additional cost if the flexible circuit is foamed in. In such an embodiment, an integrating foam has been found to be advantageous so that the flexible circuit can be supported elastically and resiliently in the areas of the connection, while the outside of the housing is foamed to form a hard surface. Such elastic resiliency improves the contact, particularly in environments where the temperature is varied. The ends of the cable can be used without the need for further structure as the feed elements, in embodiments where the sealing member is provided with inlet openings for the cable ends which extend into the surface area of the sealing member. In this embodiment, the bare cable ends protrude through window-like openings in the surface and can be brought into electrically conducting contact with the connecting elements.

In one advantageous embodiment of the invention where the feed can be made in any direction, the connecting elements are located on the inside surface of a cylindrical recess of the housing. This is particularly advantageous in arrangements where the inlet opening for the cable ends enters at an angle of approximately 45° with respect to the insertion direction of the sealing member. It is an advantage of this arrangement that it is not necessary to bend the feed sharply.

In a further embodiment of the invention, additional protection can be provided for the lead by forming the inlet opening into a trumpet shape. In embodiments where the cable lead-in is arranged symmetrically, it is advantageous if the compression device is a clamping member which is centrally located in the cylindrical sealing member. The clamping member may be a clamping screw which is cooperatively engaged with a threaded cup. The present invention is particularly useful as a cable lead-in for the circuitry of a contactless proximity switch or other similar sensor.

BRIEF DESCRIPTION OF THE DRAWINGS

Comprehension of the invention is facilitated by reading the following detailed description in conjunction with the annexed drawings, in which.

DETAILED DESCRIPTION

Figure 1:
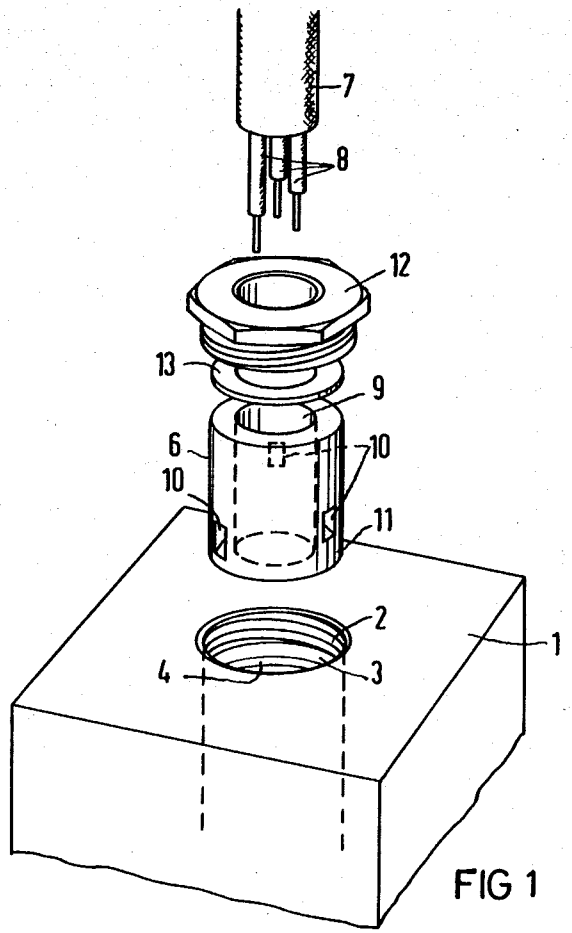
FIG. 1 is an isometric, exploded view of a cable lead-in having a screw-type compression gland, constructed in accordance with the principles of the invention.

FIG. 1 shows a cable lead-in arrangement constructed in accordance with the principles of the invention. The figure shows an equipment 1 having a cylindrical recess 2, into which is arranged a flexible circuit 3 which has circular ring contact elements or endless bands 4. A sealing member 6 which is designed as a cylinder is inserted into cylindrical recess 2 of equipment 1. A cable 7 having, in this embodiment, a plurality of conductor elements 8, is introduced into a lead-in opening 9. The ends of conductor elements 8, after the cable has been brought into lead-in opening 9, are arranged to protrude through window-like recesses 10 such that they extend beyond an outer surface 11 of sealing member 6. In this manner, the conductors are brought into contact with ring contact elements 4 when sealing member 6 is inserted into cylindrical recess 2. In this embodiment, window-like recesses 10 are staggered in height according to the position of the ring contact elements 4.

In the specific illustrative embodiment, a hexagonal nut 12, which is customarily used in screw-type compression glands, serves to clamp sealing member 6 in cylindrical recess 2. A metal washer 13 is interposed between the hexagonal nut and the sealing member.

Figure 2:
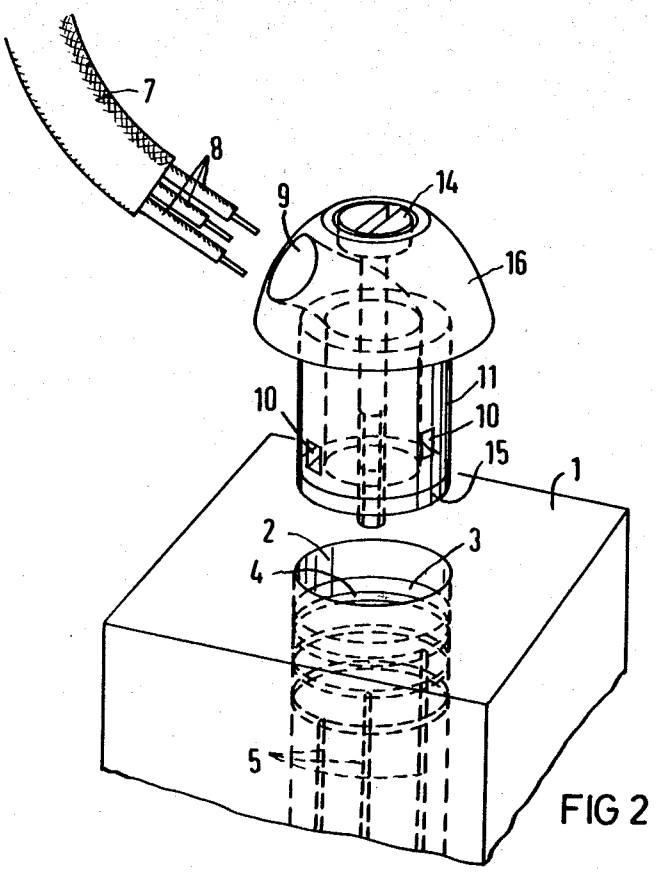
FIG. 2 is an isometric, exploded view of an embodiment of the invention having an asymmetrical cable lead-in and a centered clamping screw.

FIG. 2 shows an embodiment of the invention wherein there is provided a centrally arranged clamping screw 14 which cooperates with a clamping plate 15. In this embodiment, lead-in opening 9 is arranged to be off-center and is terminated in a fashion in which the opening gradually narrows as at the mouth or sound outlet of a trumpet, and in which the opening extends at an angle of approximately 45° with respect to the center axis so that the cable can be directed into the equipment without sharp bends in the direction of the clamping screw as well as in a plane extending at approximately 90° thereto. The embodiment of the invention shown in FIG. 2 is provided with a cap-like extension 16 which enables sealing member 6 to be inserted into recess 2 to a predetermined depth. Moreover, cap-like extension 16 obviates the need for an additional seal at the surface of equipment 1.

Interconnection to the equipment is achieved by inserting cable 7 with its conductor elements 8 into lead-in opening 9. The lead-in opening divides the conductor elements so that the bar ends extend through window-shaped openings 10 from surface 11 of sealing member 6. As shown in the drawing, the canals which extend through sealing member 6 to window-like recesses 10 may be provided with a slight curvature in order to facilitate protrusion of the bare conductors. Once such engagement has been achieved, sealing member 6 is inserted, together with cable 7, into recess 2. The electrical connection between conductor ends 8 and the circular ring contact elements 4 is accomplished, when sealing member 6 is clamped, by turning clamping screw 14, or tightening hexagonal nut 12 in the embodiment of FIG. 1. Thus, elastic sealing member 6 is pressed against the inner cylindrical walls of cylindrical recess 2 such that a good seal is achieved against environmental influences such as moisture. Moreover, an advantageously high contact pressure for the electrical connections is made. As shown in FIG. 2, equipment 1 is provided with connecting lines 5 which coupled ring contact elements 4 to the internal circuitry of the equipment (not shown). Such connecting lines are also provided in the embodiment of FIG. 1.

The present inventive lead-in arrangement provides the advantage that, in situations where a sensor such as a contactless proximity switch is desired to be supplied by a cable, the cable need not be provided from the manufacturer. Such a cable can be connected in accordance with the present invention at the installation site without difficulty, and no difficulties are anticipated with the sealing of the cable lead-in. If necessary, the ends of the conductors can be provided with conducting clamping parts which can be particularly adapted to contacting ring contact elements 4. Such an arrangement is of particular interest in embodiments where the material of the conductor ends cannot be contacted by ring contact elements 4. As a result of the quasi-liquid characteristics of the soft sealing plug, the contact pressure of the contacts can be increased if the conductor ends are provided with a cylindrical pressure plate, similar to a piston. This pressure plate could be formed of metal and designed at the same time as the contact for piercing the conductor insulation.

Although the invention has been described in terms of specific embodiments and applications, persons skilled in the art, in light of this teaching, can produce additional embodiments without departing from the spirit or exceeding the scope of the claimed invention. Accordingly, it is to be understood that the the drawings and descriptions in this disclosure are proffered to facilitate comprehension of the invention and should not be construed to limit the scope thereof.

What is claimed is:

1. A cable lead-in arrangement for encapsulated electrical equipment, the arrangement being of the type having an elastically compressible sealing member which surrounds the cable and is braced between the cable and a housing of the equipment, the arrangement further comprising:

a contact element inserted in the housing of the equipment for contacting conductor elements of the cable which are arranged to extend through the sealing member, said contact element being incorporated in a flexible circuit encapsulated in foam; and compression means for applying a compression force to the sealing member, said sealing member being provided with insertion openings through which are inserted said conductor elements of the cable so as to protrude to the surface region of the sealing member, the arrangement being provided with an entrance opening for entry of the cable.

2. The cable lead-in arrangement of claim 1 wherein said contact element is arranged in the form of a ring against a inside surface of a cylindrical recess in the housing of the equipment.

3. The cable lead-in arrangement of claim 1 wherein the cable enters the arrangement at an angle of approximately 45° with respect to a longitudinal axis of the sealing member.

4. The cable lead-in arrangement of claim 3 wherein the entrance opening gradually narrows as at the mouth of a trumpet.

5. The cable lead-in arrangement of claim 1 wherein said compression means is arranged parallel with an axis of the sealing member.

6. The cable lead-in arrangement of claim 1 wherein the equipment comprises a sensor.

7. A cable lead-in arrangement for encapsulated electrical equipment, the arrangement being of the type having an elastically compressible sealing member which surrounds the cable and is braced between the cable and a housing of the equipment, the arrangement further comprising:

a plurality of contact elements in the form of endless bands inserted in the housing of the equipment for contacting respective conductor elements of the cable, said sealing member having a longitudinal axis and a surface region provided with a plurality of windows longitudinally staggered with respect to one another relative to said axis and angularly spaced from one another, said conductor elements having terminal portions inserted through said sealing member to extend through respective ones of said windows to said surface region, said endless bands being longitudinally spaced from one another in a direction parallel to said axis at distances corresponding to the longitudinal distances between said windows; and compression means for applying a compression force to said sealing member.

* * * * *